US011040854B2

(12) United States Patent
Sudi et al.

(10) Patent No.: US 11,040,854 B2
(45) Date of Patent: Jun. 22, 2021

(54) RESETTING GOVERNOR SUB-SYSTEMS

(71) Applicant: Otis Elevator Company, Farmington, CT (US)

(72) Inventors: Sandeep Sudi, Farmington, CT (US); Aayush Desai, New Britain, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 663 days.

(21) Appl. No.: 15/911,077

(22) Filed: Mar. 3, 2018

(65) Prior Publication Data

US 2019/0270613 A1 Sep. 5, 2019

(51) Int. Cl.

| | |
|---|---|
| ***B66B 5/00*** | (2006.01) |
| ***B66B 5/04*** | (2006.01) |
| ***B66B 1/06*** | (2006.01) |
| ***B66B 1/34*** | (2006.01) |
| ***B66B 3/00*** | (2006.01) |
| *B66B 25/00* | (2006.01) |

(52) U.S. Cl.

CPC ..... *B66B 5/0087* (2013.01); *B66B 1/06* (2013.01); *B66B 1/3461* (2013.01); *B66B 3/002* (2013.01); *B66B 5/0006* (2013.01); *B66B 5/0012* (2013.01); *B66B 5/0025* (2013.01); *B66B 5/044* (2013.01); *B66B 25/006* (2013.01)

(58) Field of Classification Search

USPC ..... 187/390

See application file for complete search history.

(56) References Cited

U.S. PATENT DOCUMENTS

| | | | | |
|---|---|---|---|---|
| 4,418,795 | A * | 12/1983 | Trosky | B66B 5/0025 187/391 |
| 6,161,653 | A | 12/2000 | Skalski et al. | |
| 6,186,281 | B1 | 2/2001 | Pietrzykowski et al. | |
| 6,196,355 | B1 | 3/2001 | Fargo et al. | |
| 6,269,911 | B1 | 8/2001 | Richter | |
| 6,364,066 | B1 | 4/2002 | Bolch et al. | |
| 7,073,633 | B2 | 7/2006 | Weinberger et al. | |

(Continued)

FOREIGN PATENT DOCUMENTS

| | | |
|---|---|---|
| CN | 1277140 A | 12/2000 |
| CN | 102196986 A | 9/2011 |

(Continued)

OTHER PUBLICATIONS

Search Report Application No. EP19160384; dated Dec. 17, 2019; pp. 7.

*Primary Examiner* — Christopher Uhlir

(74) *Attorney, Agent, or Firm* — Cantor Colburn LLP

(57) ABSTRACT

A method of operating an elevator or escalator system is provided. The method includes alerting a mechanic of a shutdown of a vehicle of the elevator or escalator system and providing data indicative of an occupancy condition of the vehicle to the mechanic so that the mechanic can execute, in any order, a verification of a no-occupancy condition, a switch of a mode of operation of the elevator or escalator system to a recovery mode and an inspection for faults. The method further includes initiating an overspeed (OS) switch reset routine in an event the mechanic confirms that an actuation of the OS switch is an exclusive cause of the shutdown and remotely triggers the OS switch reset routine accordingly.

20 Claims, 3 Drawing Sheets

(56) References Cited

U.S. PATENT DOCUMENTS

| | | | | |
|---|---|---|---|---|
| 7,237,765 | B2 | 7/2007 | Mateo Mur | |
| 7,350,626 | B2 | 4/2008 | Lence et al. | |
| 7,448,473 | B2 | 11/2008 | Lindberg et al. | |
| 7,575,099 | B2 | 8/2009 | Oh et al. | |
| 7,761,921 | B2 | 7/2010 | Gannon et al. | |
| 8,069,958 | B2 | 12/2011 | Lence-Barreiro | |
| 8,136,635 | B2 * | 3/2012 | Christy | B66B 5/0031 187/249 |
| 8,540,057 | B2 | 9/2013 | Schuster et al. | |
| 8,939,262 | B2 | 1/2015 | Schienda et al. | |
| 9,027,714 | B2 | 5/2015 | Husmann et al. | |
| 9,067,760 | B2 | 6/2015 | Bunter et al. | |
| 9,580,276 | B2 | 2/2017 | Toutaoui | |
| 9,734,003 | B2 | 8/2017 | Sekine et al. | |
| 2011/0272223 | A1 | 11/2011 | Drayer et al. | |
| 2015/0251875 | A1 | 9/2015 | Lustenberger | |

FOREIGN PATENT DOCUMENTS

| | | | |
|---|---|---|---|
| CN | 203754158 | U | 8/2014 |
| CN | 104661945 | A | 5/2015 |
| CN | 105819301 | A | 8/2016 |
| CN | 106256746 | A | 12/2016 |
| CN | 205772612 | U | 12/2016 |
| EP | 0148000 | A1 | 7/1985 |
| EP | 2336070 | B1 | 8/2016 |
| EP | 2900581 | B1 | 9/2016 |
| EP | 3106417 | A1 | 12/2016 |
| JP | 2922045 | B2 | 7/1999 |
| JP | 2000302349 | A | 10/2000 |
| JP | 2001341956 | A | 12/2001 |
| JP | 4509522 | B2 | 7/2010 |
| KR | 1020080107900 | A | 12/2008 |
| WO | 2007011359 | A1 | 1/2007 |

* cited by examiner

RESETTING GOVERNOR SUB-SYSTEMS

BACKGROUND

The following description relates to elevator or escalator safety systems and, more specifically, to an automated procedure for resetting governor sub-systems.

Certain elevator or escalator systems include relatively light components and sometimes experience harsh or fast stops. In some cases, there could be as many as twenty or more such stops each day and each stop could lead to a governor overspeed (OS) condition being in effect that results in the activation of an OS switch. The activation of the OS switch causes an unwanted shutdown of the elevator or escalator system without actuating of safety brakes. To reset the OS switch, a mechanic will need to visit the site and reset the system. This is time consuming and a source of service overhead.

BRIEF DESCRIPTION

According to an aspect of the disclosure, a method of operating an elevator or escalator system is provided. The method includes alerting a mechanic of a shutdown of a vehicle of the elevator or escalator system and providing data indicative of an occupancy condition of the vehicle to the mechanic so that the mechanic can execute, in any order, a verification of a no-occupancy condition, a switch of a mode of operation of the elevator or escalator system to a recovery mode and an inspection for faults. The method further includes initiating an overspeed (OS) switch reset routine in an event the mechanic confirms that an actuation of the OS switch is an exclusive cause of the shutdown and remotely triggers the OS switch reset routine accordingly.

In accordance with additional or alternative embodiments, the method includes providing data indicative of fault clearing to the mechanic following OS switch reset routine completion.

In accordance with additional or alternative embodiments, the mechanic is located remotely from the elevator or escalator system and the data indicative of the occupancy condition is provided via a remote connection.

In accordance with additional or alternative embodiments, the inspection for faults includes reviewing readings of sensors of the vehicle and the data indicative of the occupancy condition is generated from readings of detectors of the vehicle.

In accordance with additional or alternative embodiments, the method further includes managing a site visit in an event the mechanic confirms that a fault condition is in effect which is different from the actuation of the OS switch.

In accordance with additional or alternative embodiments, the method further includes determining if the elevator car runs normally following the providing of the data indicative of the fault clearing and managing a site visit in an event it is determined that the elevator car does not run normally following the providing of the data indicative of the fault clearing.

According to an aspect of the disclosure, an elevator or escalator system is provided. The elevator or escalator system includes an overspeed (OS) switch which is designed to activate when a vehicle of the elevator or escalator system meets or exceeds a predetermined velocity or acceleration condition, a sensor for detecting a condition of the vehicle, a detector for detecting occupancy of the vehicle and a communication gateway by which a remote mechanic is alerted of a shutdown event of the vehicle, the remote mechanic remotely determines whether activation of the OS switch is the exclusive cause of the shutdown event and whether the vehicle is unoccupied and the remote mechanic remotely resets the OS switch if activation of the OS switch is the exclusive cause of the shutdown event and the vehicle is unoccupied.

In accordance with additional or alternative embodiments, in an event the vehicle is an elevator car, the elevator or escalator system further includes a structure defining a hoistway in which the elevator car is movably disposed and a governor element to control hoistway movements of the elevator car.

In accordance with additional or alternative embodiments, a controller is receptive of data from the governor element and the sensor and is configured to determine a shutdown event cause.

In accordance with additional or alternative embodiments, the elevator car and the governor element are operable in a normal and a recovery mode.

In accordance with additional or alternative embodiments, a remote reset of the OS switch requires current recovery mode operation.

In accordance with additional or alternative embodiments, the sensor includes one or more vibration sensors, and the detector includes one or more cameras.

According to an aspect of the disclosure, an elevator or escalator system is provided. The elevator or escalator system includes a structure defining a movement pathway, a vehicle movably disposed in the movement pathway, a governor element to sense movements of the vehicle in the movement pathway and a communication gateway. The governor element includes an overspeed (OS) switch which is activated when the vehicle meets or exceeds a predetermined velocity or acceleration condition, the vehicle includes a sensor for detecting a vehicle condition and a detector for detecting vehicle occupancy and the communication gateway permits a remote mechanic to be alerted to a shutdown event, remotely determine from sensor and detector output whether activation of the OS switch is the exclusive cause of the shutdown event and whether the vehicle is unoccupied, and remotely reset the OS switch if activation of the OS switch is the exclusive cause of the shutdown event and the vehicle is unoccupied.

In accordance with additional or alternative embodiments, the movement pathway, the vehicle and the governor element are plural in number and are independently operable.

In accordance with additional or alternative embodiments, the governor element is a machine room-less (MRL) governor element.

In accordance with additional or alternative embodiments, the vehicle and the governor element are operable in a normal and a recovery mode.

In accordance with additional or alternative embodiments, a remote reset of the OS switch requires current recovery mode operation.

In accordance with additional or alternative embodiments, the sensor includes one or more vibration sensors and the detector includes one or more cameras.

In accordance with additional or alternative embodiments, a controller is receptive of data from the governor element, the sensor and the detector.

In accordance with additional or alternative embodiments, the controller is configured to determine a shutdown event cause.

These and other advantages and features will become more apparent from the following description taken in conjunction with the drawings.

BRIEF DESCRIPTION OF THE DRAWINGS

The subject matter, which is regarded as the disclosure, is particularly pointed out and distinctly claimed in the claims at the conclusion of the specification. The foregoing and other features and advantages of the disclosure are apparent from the following detailed description taken in conjunction with the accompanying drawings in which:

These and other advantages and features will become more apparent from the following description taken in conjunction with the drawings.

DETAILED DESCRIPTION

As will be described below, an approach to reset the overspeed (OS) switch on elevator or escalator systems without requiring a technician's jobsite visit is provided. The approach makes use of sensors for smart service and a connected elevator or escalator system whereby a remote mechanic is empowered with tools to reset the OS switch. The approach includes alerting of a mechanic of a shutdown, a mechanic confirming shutdown remotely and using a camera or a motion detector/load weighing information to check for occupancy. The approach further includes the mechanic checking controller fault logs and confirming that only the OS switch has actuated and the mechanic using sensor data to verify that the OS switch trip was because of an OS condition or any other reason. When it is determined that the car is empty and if the OS switch trip was due to any reason other than an OS condition, the approach also includes the mechanic sending a signal to a controller to reset the OS switch. The logic to reset the OS switch either can be automated in the controller or it could be processed in a remote system and/or on a mechanic's phone.

While the description provided herein can relate to any passenger movement system, such as an elevator system or an escalator system, the following description will relate only to the case of the elevator system. This is done for purposes of clarity and brevity and should not be interpreted as limiting the scope of the description in any manner.

Figure 1:
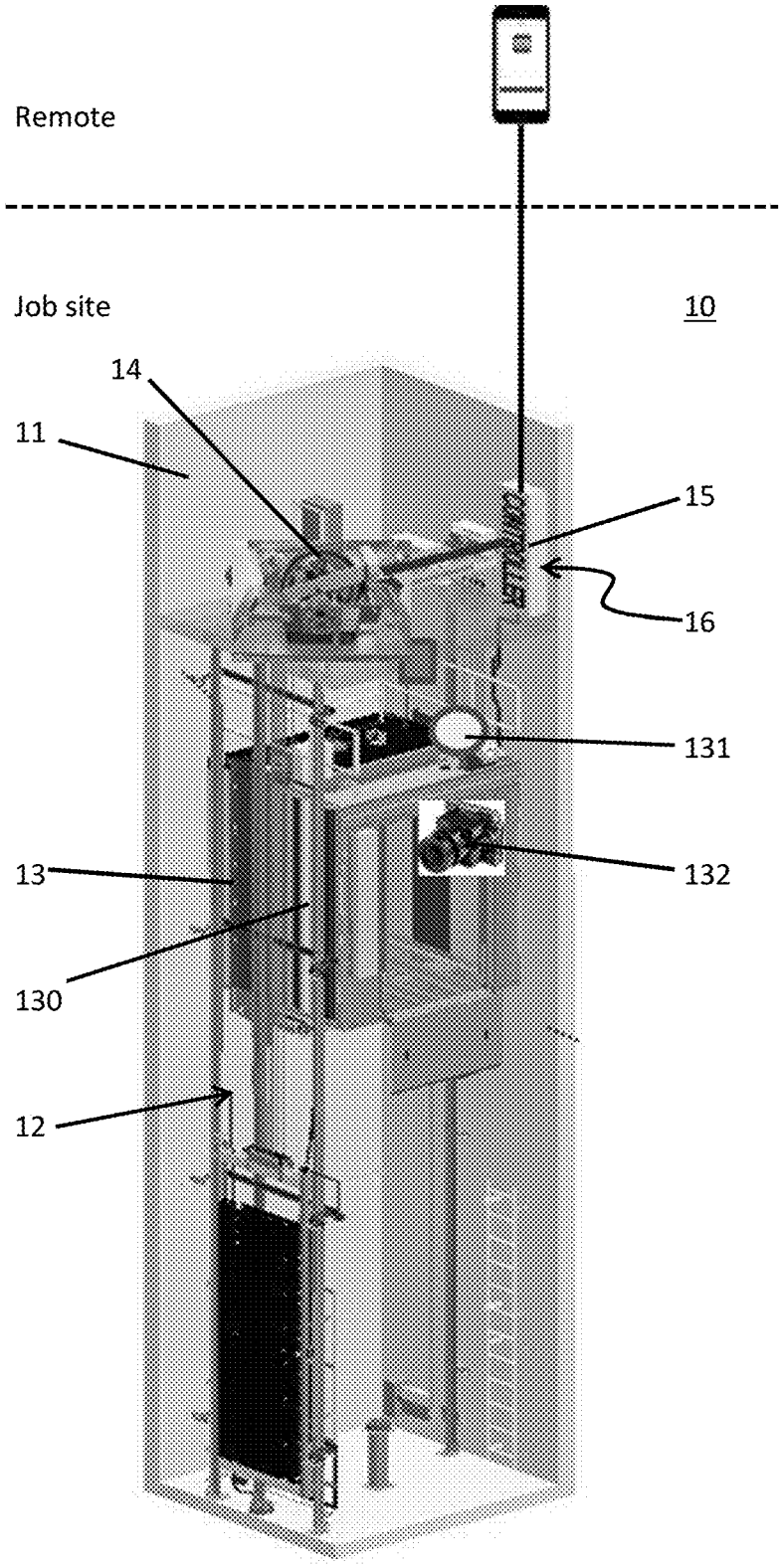
FIG. 1 is a perspective view of an elevator system in accordance with embodiments.

With reference to FIG. 1, an elevator system 10 is provided and includes a structure 11 defining a movement pathway or hoistway 12, a vehicle or an elevator car 13 that is movably disposed in the hoistway 12, a governor element 14 to control movements of the elevator car 13 in the hoistway 12 and a communication gateway 15.

While the governor element 14 is shown as a traditional roped top of the hoistway governor, embodiments of the invention are not so limited. The governor element 14 may be located at any desired location in the hoistway 12 including the bottom, on the elevator car 13 or elsewhere. Moreover, the invention is not limited to roped governors and may also apply to electronic governor assemblies as well as all other known governor assemblies. In one embodiment, the governor element 14 may be a machine room-less (MRL) governor.

Figure 2:
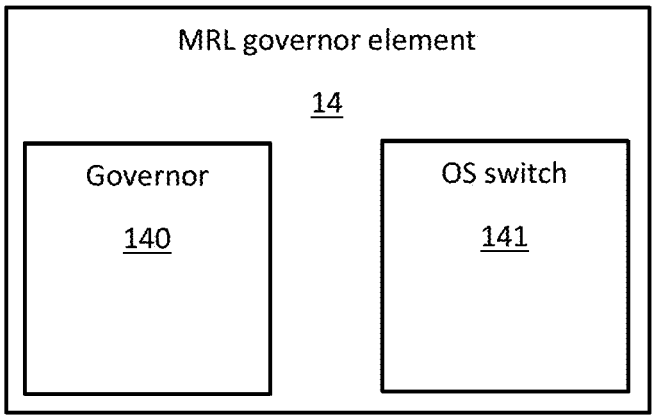
FIG. 2 is a schematic diagram of a governor element of the elevator system of FIG. 1 in accordance with embodiments.

With reference to FIG. 2, the exemplary governor element 14 includes a governor 140 which is coupled to the elevator car 13 and configured to monitor upward and downward movements of the elevator car 13 in the hoistway 12 and an overspeed (OS) switch 141. The OS switch 141 is trippable by excessively fast upward or downward movements and/or accelerations of the elevator car 13 in the hoistway 12.

The elevator car 13 is a generally rectangular body 130 with doors that open and close to permit passenger entry and exit at each floor of the structure 11 that is serviced by the elevator system 10 and a user interface by which the passengers can indicate which floors to which they want to move. The elevator car 13 further includes a sensor 131 and a detector 132. The sensor 131 may be provided as one or more sensors 131, such as vibration sensors or accelerometers configured for detecting vibration of the elevator car 13 during normal and abnormal operations of the elevator system 10. In particular, the sensor 131 may be provided as a vibration sensor that is configured to detect vibration of the elevator car 13 before, during or after a shutdown event with respect to the elevator car 13. The detector 132 may be provided as one or more detectors, such as one or more cameras, microphones, pressure mats or other known sensors for detecting an occupancy condition of the elevator car 13.

In accordance with embodiments, the elevator system 10 or, more particularly, the elevator car 13 may include a controller 16. The controller 16 is receptive of data from at least one of the governor element 14, the sensor 131 and the detector 132 and is configured to determine a cause of a shutdown event. For example, in an event of a shutdown event of the elevator car 13 where the OS switch 141 is tripped and the governor element 14 sends a corresponding OS switch trip signal to the controller 16 but the sensor 131 does not report any unusual vibration, the controller 16 may determine that the OS switch trip was the sole or exclusive cause of the shutdown event of the elevator car 13. By contrast, in an event of a shutdown event of the elevator car 13 where the OS switch 141 is tripped and the governor element 14 sends a corresponding OS switch trip signal to the controller 16. The controller 16 may determine that the OS switch trip was not the sole or exclusive cause of the shutdown event of the elevator car 13 in an event the sensor 131 also reported that unusual or abnormal vibrations levels were experienced by the elevator car 13 (i.e., due to the elevator car 13 falling unusually fast for a moment and then stopping quickly).

Figure 3:
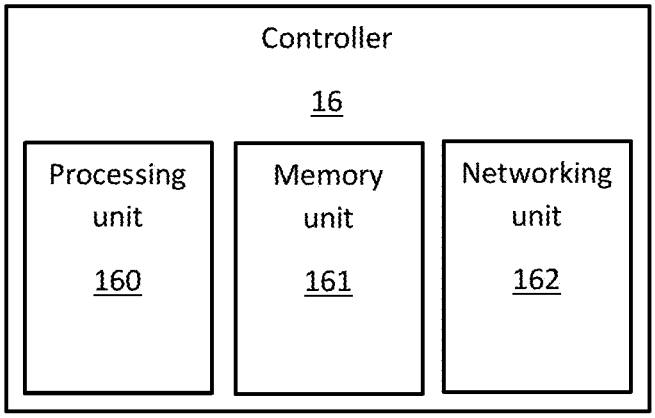
FIG. 3 is a schematic diagram of a controller of the elevator system of FIG. 1 in accordance with embodiments.

With reference to FIG. 3, the controller 16 may include a processing unit 160, a memory unit 161 and a networking unit 162 which is disposed in signal communication with at least the governor element 14, the sensor 131 and the communication gateway 15. The memory unit 161 has executable instructions stored thereon, which are readable and executable by the processing unit 160. When read and executed by the processing unit 160, the executable instructions cause the processing unit 160 to operate substantially as described herein.

In accordance with embodiments, the elevator car 13 and the governor element 14 are operable in normal and recovery modes.

Although FIG. 1 illustrates the elevator system 10 with a single hoistway 12, a single elevator car 13 and a single governor element 14, it is to be understood that this is not required and that the elevator system 10 may include multiple independently controllable or operable hoistways 12, elevator cars 13 and governor elements 14.

The communication gateway 15 may be provided as a transmission/reception module which is communicative with various components of the elevator system 10 as described above and with an external communication device of a remote mechanic (e.g., a smartphone or computing device). The communication gateway 15 permits the remote mechanic to be alerted to a shutdown event of the elevator car 13 and to remotely determine from output of the sensor 131 and the controller 16 whether the OS switch 141 is or has been actuated as an exclusive cause of the shutdown event and from output of the detector 132 whether the elevator car 13 is unoccupied. The communication gateway 15 is further configured to permit the remote mechanic to remotely engage the recovery mode of operation of the elevator system 10 and/or the elevator car 13 and to remotely reset the OS switch 141 if the OS switch 141 is actuated as the exclusive cause of the shutdown event of the elevator car 13 and if the elevator car 13 is unoccupied.

Figure 4:
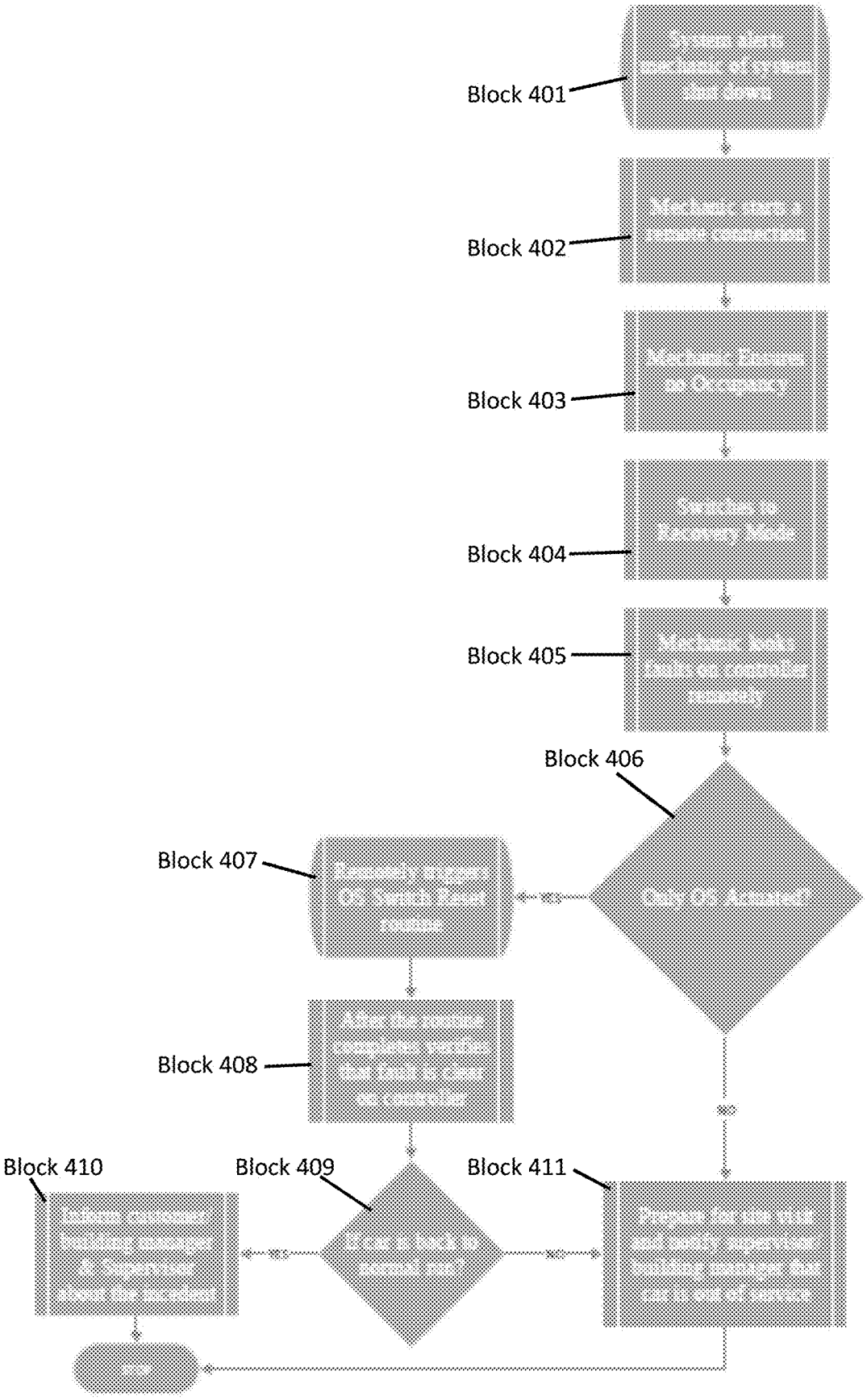
FIG. 4 is a flow diagram illustrating a method of operating an elevator or escalator system in accordance with embodiments.

With reference to FIG. 4, a method of operating the elevator system 10 will now be described. As shown in FIG. 4, the method includes alerting a remote mechanic of a shutdown event of the elevator car 13 of the elevator system 10 (block 401) whereupon the remote mechanic can initiate a remote connection by way of the communication gateway 15 (block 402) and determine from an output of the detector 132 or, in some cases, the sensor 131 whether the elevator car 13 is unoccupied (block 403). Here, the output of the detector 132 (and the sensor 131) may be provided upon request as data indicative of an occupancy condition of the elevator car 13 to the remote mechanic so that the remote mechanic can verify a no-occupancy condition. In addition, by way of the communication gateway 15, once the remote mechanic verifies or confirms the no-occupancy condition, the remote mechanic can cause the elevator system 10 and/or the elevator car 13 to switch to the recovery mode (block 404). In addition, the remote mechanic can then determine with or without the use or input of the controller 16 the cause of the shutdown event from an output of the sensor 131 (block 405).

In an event the cause of the shutdown event is determined to be exclusively a tripping of the OS switch 141 and the elevator car 13 is determined to be unoccupied (block 406), the remote mechanic can then cause the elevator system 10 and/or the elevator car 13 to remotely initiate an OS switch reset routine (block 407). At this point, following OS switch reset routine completion, the method further includes providing data indicative of fault clearing from the controller 16 and to the remote mechanic by way of the communication gateway 15 (block 408). Next, it is determined whether the elevator car 13 returns to normal operations (block 409). Such determining may be based, for example, on additional data being generated by the sensor 131 and the detector 132 and then forwarded or transmitted to the remote mechanic by way of the remote gateway 15. Then, in an event the elevator car 13 is determined to have returned to normal operation, an incident descriptive alert is generated and issued (block 410).

In an event the cause of the shutdown event is determined to be not exclusively based on the tripping of the OS switch 141 or in an event the elevator car 13 does not return to normal operation as determined during block 409 following the provision of data indicative of the fault clearing of block 408, the method may also include managing a site visit. Such management of the site visit may be characterized by, for example, preparation for and scheduling of the site visit, notifying a building manager of the elevator car 13 being out of service, etc. (block 411).

Benefits of the features described herein are that remote mechanics do not have to visit job sites for OS resets and that safety systems can be monitored remotely with remote intervention capability.

While the disclosure is provided in detail in connection with only a limited number of embodiments, it should be readily understood that the disclosure is not limited to such disclosed embodiments. Rather, the disclosure can be modified to incorporate any number of variations, alterations, substitutions or equivalent arrangements not heretofore described, but which are commensurate with the spirit and scope of the disclosure. Additionally, while various embodiments of the disclosure have been described, it is to be understood that the exemplary embodiment(s) may include only some of the described exemplary aspects. Accordingly, the disclosure is not to be seen as limited by the foregoing description, but is only limited by the scope of the appended claims.

What is claimed is:

1. A method of operating an elevator or escalator system, the method comprising:

alerting a mechanic of a shutdown of a vehicle of the elevator or escalator system;

providing data indicative of an occupancy condition of the vehicle to the mechanic so that the mechanic executes, in any order:

a verification of a no-occupancy condition, a switch of a mode of operation of the elevator or escalator system to a recovery mode, and an inspection for faults; and initiating an overspeed (OS) switch reset routine responsive to the mechanic confirming that an actuation of the OS switch is an exclusive cause of the shutdown and remotely triggers the OS switch reset routine accordingly.

2. The method according to claim 1, further comprising providing data indicative of fault clearing to the mechanic following OS switch reset routine completion.

3. The method according to claim 1, wherein:

the mechanic is located remotely from the elevator or escalator system, and the data indicative of the occupancy condition is provided via a remote connection.

4. The method according to claim 1, wherein:

the inspection for faults comprises reviewing readings of sensors of the vehicle, and the data indicative of the occupancy condition is generated from readings of detectors of the vehicle.

5. The method according to claim 1, further comprising managing a site visit responsive to the mechanic confirming that a fault condition is in effect which is different from the actuation of the OS switch.

6. The method according to claim 2, further comprising:

determining that the vehicle runs normally following the providing of the data indicative of the fault clearing; and managing a site visit responsive to it being determined that the vehicle does not run normally following the providing of the data indicative of the fault clearing.

7. An elevator or escalator system, comprising:

an overspeed (OS) switch which is designed to activate when a vehicle of the elevator or escalator system meets or exceeds a predetermined velocity or acceleration condition;

a sensor for detecting a condition of the vehicle;

a detector for detecting occupancy of the vehicle; and a communication gateway by which:

a remote mechanic is alerted of a shutdown event of the vehicle, activation of the OS switch is being the exclusive cause of the shutdown event and the vehicle being unoccupied are remotely determined, and the OS switch is remotely reset responsive to activation of the OS switch being determined to be the exclusive cause of the shutdown event and responsive to the vehicle being determined to be unoccupied.

8. The elevator or escalator system according to claim 7, wherein, responsive to the vehicle being an elevator car, the elevator or escalator system further comprises:

a structure defining a hoistway in which the elevator car is movably disposed; and a governor element to control hoistway movements of the elevator car.

9. The elevator or escalator system according to claim 8, further comprising a controller which is receptive of data from the governor element and the sensor and which is configured to determine a shutdown event cause.

10. The elevator or escalator system according to claim 8, wherein the elevator car and the governor element are operable in a normal and a recovery mode.

11. The elevator or escalator system according to claim 10, wherein a remote reset of the OS switch requires current operation in the recovery mode.

12. The elevator or escalator system according to claim 7, wherein:

the sensor comprises one or more vibration sensors, and the detector comprises one or more cameras.

13. An elevator or escalator system, comprising:

a structure defining a movement pathway;

a vehicle movably disposed in the movement pathway;

a governor element to sense movements of the vehicle in the movement pathway; and a communication gateway, wherein:

the governor element comprises an overspeed (OS) switch which is activated when the vehicle meets or exceeds a predetermined velocity or acceleration condition, the vehicle comprises a sensor for detecting a vehicle condition and a detector for detecting vehicle occupancy, and the communication gateway permits a remote mechanic to:

be alerted to a shutdown event, remotely determine from sensor and detector output whether activation of the OS switch is the exclusive cause of the shutdown event and whether the vehicle is unoccupied, and remotely reset the OS switch responsive to activation of the OS switch being determined to be the exclusive cause of the shutdown event and responsive to the vehicle being determined to be unoccupied.

14. The elevator or escalator system according to claim 13, wherein the movement pathway, the vehicle and the governor element are plural in number and are independently operable.

15. The elevator or escalator system according to claim 13, wherein the governor element is a machine room-less (MRL) governor element.

16. The elevator or escalator system according to claim 13, wherein the vehicle and the governor element are operable in a normal and a recovery mode.

17. The elevator or escalator system according to claim 16, wherein a remote reset of the OS switch requires current operation in the recovery mode.

18. The elevator or escalator system according to claim 13, wherein:

the sensor comprises one or more vibration sensors, and the detector comprises one or more cameras.

19. The elevator or escalator system according to claim 18, further comprising a controller which is receptive of data from the governor element, the sensor and the detector.

20. The elevator or escalator system according to claim 19, wherein the controller is configured to determine a shutdown event cause.

* * * * *